US011711646B2

(12) United States Patent
Porter

(10) Patent No.: US 11,711,646 B2
(45) Date of Patent: Jul. 25, 2023

(54) AUDIO ASSEMBLY WITH LONG LEVER DIPOLES

(71) Applicant: META PLATFORMS TECHNOLOGIES, LLC, Menlo Park, CA (US)

(72) Inventor: Simon Porter, San Jose, CA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 90 days.

(21) Appl. No.: 17/344,747

(22) Filed: Jun. 10, 2021

(65) Prior Publication Data

US 2022/0159366 A1 May 19, 2022

Related U.S. Application Data

(60) Provisional application No. 63/115,430, filed on Nov. 18, 2020.

(51) Int. Cl.
*H04R 1/10* (2006.01)

(52) U.S. Cl.
CPC ..... *H04R 1/1066* (2013.01); *H04R 1/1008* (2013.01); *H04R 2460/13* (2013.01)

(58) Field of Classification Search
CPC ..... H04R 1/1066; H04R 1/1008; H04R 2460/13; H04R 2400/11; H04R 7/18; H04R 1/347; H04R 5/033
See application file for complete search history.

(56) References Cited

U.S. PATENT DOCUMENTS

2007/0121986 A1* 5/2007 Shim ..... H04R 1/345 381/372
2011/0058704 A1* 3/2011 Harlow ..... H04R 1/24 381/380
2015/0237437 A1* 8/2015 Hu ..... H04R 1/1058 381/338
2015/0264467 A1* 9/2015 Annunziato ..... H04R 1/1058 381/380
2015/0382100 A1* 12/2015 Azmi ..... H04R 1/1091 381/380

(Continued)

OTHER PUBLICATIONS

International Search Report and Written Opinion for International Application No. PCT/US2021/059292, dated Mar. 7, 2022, 9 pages.

*Primary Examiner* — Oyesola C Ojo
(74) *Attorney, Agent, or Firm* — Fenwick & West LLP

(57) ABSTRACT

An audio assembly provides audio content to a user. The audio assembly comprises an elongated body, a diaphragm, a transducer, and a plurality of vent assemblies. The elongated body has a first end and a second end opposite the first end. The diaphragm is within the elongated body and pivots about a pivot location that is proximate the second end. The transducer is within the elongated body and is positioned proximate to the first end. The transducer causes the diaphragm to pivot about the pivot location such that the diaphragm generates a positive acoustic pressure wave from a first surface of the diaphragm and a negative acoustic pressure wave from a second surface of the diaphragm. The plurality of vent assemblies are along one or more surfaces of the elongated body, and are configured to vent the positive acoustic pressure wave and the negative acoustic pressure wave.

20 Claims, 5 Drawing Sheets

(56) References Cited

U.S. PATENT DOCUMENTS

| | | | | |
|---|---|---|---|---|
| 2018/0242070 | A1* | 8/2018 | Slater | F04F 7/00 |
| 2018/0255386 | A1* | 9/2018 | Bristol | G02B 27/0176 |
| 2021/0044688 | A1* | 2/2021 | Rusconi Clerici Beltrami | H04R 1/2842 |
| 2021/0345036 | A1* | 11/2021 | Van Hook | H04R 1/38 |

* cited by examiner

AUDIO ASSEMBLY WITH LONG LEVER DIPOLES

CROSS-REFERENCE TO RELATED APPLICATIONS

This application claims the benefit of U.S. Provisional Application No. 63/115,430, filed Nov. 18, 2020, which is incorporated by reference in its entirety.

FIELD OF THE INVENTION

This present disclosure generally relates to audio assemblies used in headsets, and specifically to audio assemblies with long lever dipoles.

BACKGROUND

Headsets (e.g., in an artificial reality system) often include audio assemblies configured to provide audio to a user. Some conventional audio assemblies implement monopole speakers where acoustic pressure waves propagate from a single surface towards an ear of the user. One disadvantage of using monopole speakers includes inefficiency of power usage as typical monopole speakers contain an enclosure with a fixed volume of air that increases the amount of work needed to drive the monopole speaker.

SUMMARY

The present disclosure relates to an audio assembly coupled to a headset that provides audio content to a user. The headset may include one or more audio assemblies (e.g., one for each ear). The audio assembly comprises an elongated body, a diaphragm, a transducer, and at least one vent assembly. The elongated body has a first end and a second end opposite the first end. The diaphragm within the elongated body that is configured to pivot about a pivot location that is proximate the second end. In some embodiments, the diaphragm is coupled to a bellows that is configured to hold the diaphragm. The transducer is within the elongated body and is positioned proximate to the first end. The transducer is configured to cause the diaphragm to pivot about the pivot location such that the diaphragm generates a positive acoustic pressure wave from a first surface of the diaphragm and a negative acoustic pressure wave from a second surface of the diaphragm. The plurality of vent assemblies are along one or more surfaces of the elongated body. The plurality of vent assemblies are configured to vent the positive acoustic pressure wave and the negative acoustic pressure wave.

In some embodiments, the plurality of vent assemblies include a positive vent assembly and a negative vent assembly. The negative vent assembly is in the elongated body and positioned proximate to the first end. The negative vent assembly is configured to vent the negative acoustic pressure wave. The positive vent assembly is in the elongated body and positioned proximate to the second end. The positive vent assembly is configured to output the positive acoustic pressure wave. The vented acoustic pressure waves (e.g., the positive acoustic pressure waves) may be detected by an ear of the user. The vented negative acoustic pressure waves may interfere with positive acoustic pressure waves in the far field to mitigate leakage of the audio content. The audio content may be complemented by other content provided by the headset, e.g., artificial reality content, visual content, haptic feedback content, etc.

Figure 1:
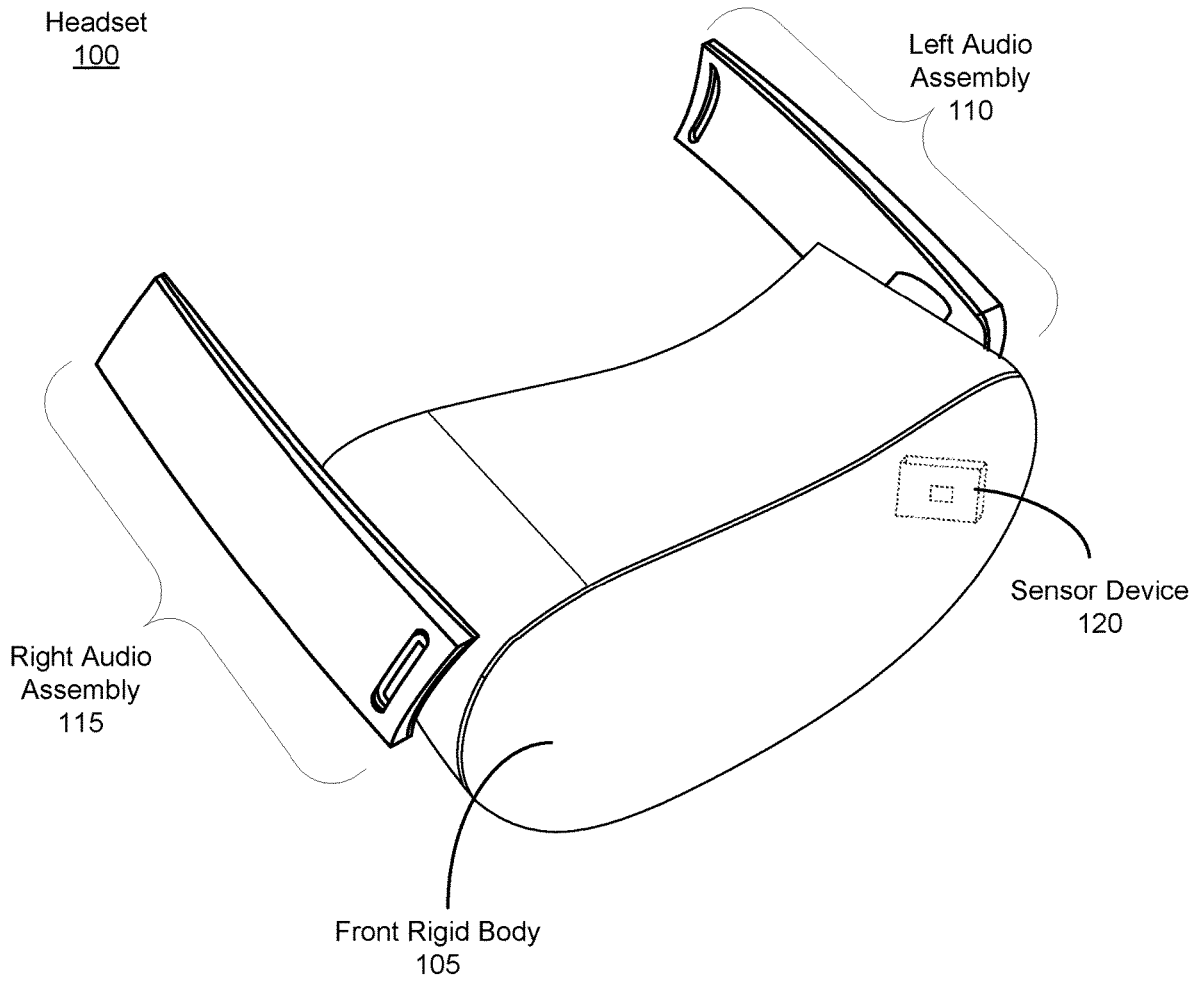
FIG. 1 is a perspective view of a headset, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Overview

A headset is configured to provide audio content to a user of the headset. The headset incorporates one or more audio assemblies that each generate acoustic pressure waves received by one or more of the user's ears as audio content. The audio assembly is configured as a dipole audio assembly that utilizes both a positive acoustic pressure wave and a negative acoustic pressure wave to create the audio content. The audio assembly comprises an elongated body, a diaphragm, a transducer, and a plurality of vent assemblies. The elongated body has a first end and a second end opposite the first end. The diaphragm within the elongated body that is configured to pivot about a pivot location that is proximate the second end. In some embodiments, the diaphragm is coupled to a bellows that is configured to hold the diaphragm. The transducer is within the elongated body and is positioned proximate to the first end. The transducer is configured to cause the diaphragm to pivot about the pivot location such that the diaphragm generates a positive acoustic pressure wave from a first surface of the diaphragm and a negative acoustic pressure wave from a second surface of the diaphragm. For example, when the diaphragm displaces forward, a high pressure zone is created in front of the diaphragm generating a positive acoustic pressure wave from the front surface of the diaphragm and a low pressure zone is created behind the diaphragm generating a negative acoustic pressure wave from the back surface of the diaphragm. The plurality of vent assemblies are along one or more surfaces of the elongated body. For example, the plurality of vent assemblies are configured to vent the positive acoustic pressure wave and the negative acoustic pressure wave. The negative vent assembly comprises one or more vents that vent the negative acoustic pressure waves generated by a back surface of the diaphragm. The positive vent assembly comprises one or more vents that vent the positive acoustic pressure waves generated from a front surface of the transducer towards a user's ear for providing the audio content to the user.

The range of motion of the diaphragm is such that the audio assembly functions as a long lever dipole. The diaphragm may be fixed at one end (e.g., proximate to the second end of the elongated body) and is actuated by the transducer at or near the opposite end of the diaphragm (e.g., proximate to the first end of the elongated body). In this manner, a range of motion of the diaphragm is greater proximate to the first end of the elongated body than a range of motion of the diaphragm proximate to the second end of the elongated body. Note that a large radiating surface area facilitates a good response in lower frequencies (e.g., better bass). The radiating surface area of the diaphragm is much larger than a surface area of the transducer in contact with the diaphragm. And because the diaphragm is fixed at one end, it effectively halves an effective displacement of the diaphragm used to generate the acoustic pressure waves.

Moreover, the audio assembly proves beneficial over conventional monopole audio assemblies in that the audio assembly yields improved sound quality in low frequencies, improved leakage reduction, and improved power efficiency. A dipole effect is created in a near field with the positive acoustic pressure waves and the negative acoustic pressure waves wherein the poles of the dipole being effectively the locations of the positive vent assembly and the negative vent assembly. Placing the positive vent assembly closer to a user's ear than the negative vent assembly results in the user's ear being closer to one pole of the dipole. This improves the bass response at low frequencies as less of the positive acoustic pressure waves are being destructively interfered with by the negative acoustic pressure waves.

Another benefit of the dipole audio assembly is leakage reduction, wherein leakage refers to the transmission of the acoustic pressure waves into the local area of the audio assembly, e.g., where other humans may hear acoustic pressure waves intended for the user of the audio assembly. In a far field, the positive acoustic pressure waves and the negative acoustic pressure waves destructively interfere (particularly at lower frequencies) reducing a degree of leakage. Note that the improvement in the bass response is dependent upon a distance between the positive vent assembly and the negative vent assembly. Accordingly, reducing the distance would likely diminish the bass response to the user as more of the negative acoustic pressure waves could be perceived by the user, but also would reduce leakage at higher acoustic frequencies (due to more destructive interference occurring at the shorter wavelengths).

The dipole audio assembly also improves power efficiency. In a conventional monopole audio assembly, a back chamber has a fixed volume of air that (i.e., not vented) effectively functions as a spring against the diaphragm. As the diaphragm displaces, the air in the back chamber is pressurized or depressurized placing a counteractive force on the diaphragm. This spring-like nature increases the amount of work on the transducer. In the dipole audio assembly, the back chamber with the volume of air is vented (e.g., via the negative vent assembly) removing the spring-like nature, thereby, improving power efficiency. Moreover, removal of the fixed-volume back chamber allows for reduction of form factor.

Embodiments of the invention may include or be implemented in conjunction with an artificial reality system. Artificial reality is a form of reality that has been adjusted in some manner before presentation to a user, which may include, e.g., a virtual reality, an augmented reality, a mixed reality, a hybrid reality, or some combination and/or derivatives thereof. Artificial reality content may include completely generated content or generated content combined with captured (e.g., real-world) content. The artificial reality content may include video, audio, haptic sensation, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a handheld device, a headset (e.g., an eyewear device, a head-mounted display (HMD) assembly with the eyewear device as a component, a HMD connected to a host computer system, a standalone HMD), a mobile device or computing system, or any other hardware platform capable of providing artificial reality content to one or more viewers. In addition, the artificial reality system may implement multiple input/output devices for receiving user input which may influence the artificial reality content provided to the user.

Headset

FIG. 1 is a perspective view of a headset 100, in accordance with one or more embodiments. The headset 100 presents content to a user. Examples of content presented by the headset 100 include visual content, audio content, haptic feedback content, artificial reality content, or some combination thereof. The headset 100 may be an eyewear device (e.g., form factor similar to that of a pair of eye glasses) or a head-mounted display (HMD). The headset 100 includes, among other components, a front rigid body 105, a band (not shown), a plurality of cameras (not shown), two audio assemblies (i.e., a left audio assembly 110, and a right audio assembly 115), a display system (not shown) and a sensor device 120. In other embodiments, the headset 100 may include fewer or additional components than those listed herein, a display system, haptic feedback devices, light sources, additional cameras, a controller, etc. Likewise, various operations described below may be variably distributed among components in the headset 100.

The front rigid body 105 holds the cameras, the sensor device 120, and the display system (not shown). The front rigid body 105 couples to a user's face around the user's eyes. The front rigid body 105 has a front side that is an exterior surface of the front rigid body 105 directed away from the user's body when the headset 100 is worn. The front rigid body 105 holds within the display system, such that the display system can provide visual content to the user's eyes. The front rigid body 105 is attached to a band which can be used to hold the front rigid body 105 to the user's face when the headset 100 is being worn by the user. The band (not shown) can be constructed by an elastic material providing sufficient force to hold the front rigid body 105 to the user's face.

The plurality of cameras capture images of an environment of the headset 100. The plurality of cameras are placed on an external surface of the rigid body 105. In some embodiments, the cameras are placed on a substantially similar plane with fields of view that overlap in part, e.g., at least a pair of cameras have an overlapping fields of view. In some implementations, two or more cameras of the plurality of cameras may have fully overlapping fields of view. The cameras are capable of capturing images in a plurality of light channels, e.g., luma, infrared, red, green or blue. Each camera comprises at least a camera sensor capable of detecting light but may also include any optical element for focusing the light and such. In some embodiments, the camera sensor provides image data comprising intensity values at each pixel of light detected in each of the plurality of light channels. Image data comprising images or video captured by the cameras may be presented to a user of the headset 100. Additionally, the headset 100 may augment the image data in some manner to generate augmented reality content. Image data may further be relied on in depth sensing of an environment where the headset 100 is operating in.

The audio assemblies are removably coupled to the front rigid body 105 on a left side and right side. The audio assemblies, including the left audio assembly 110 and the right audio assembly 115, provide audio content to a user of the headset 100. The audio assemblies are configured as dipole speakers emanating both a positive acoustic pressure wave and a negative acoustic pressure wave. As such, each audio assembly comprises an elongated body, a transducer, a diaphragm, a negative vent assembly, and a positive vent assembly. The elongated body includes an audio waveguide configured to direct positive acoustic pressure waves to an ear of the user. The negative vent assembly is configured to vent the negative acoustic pressure waves into free space. The positive vent assembly is configured to vent the positive acoustic pressure waves to the user's ear for providing audio content to the user. The positive vent assembly is closer to the user's ear than the negative vent assembly with the negative vent assembly placed in an indentation of the front rigid body 105. Placing the negative vent assembly farther from the user's ear than the positive vent assembly places the user's ear closer to one pole of the dipole (created by the positive vent assembly and the negative vent assembly) that improves bass response in low frequencies. The dipole also provides some leakage reduction (for low frequencies in particular) in a far field and provides improvements in power efficiency. The audio assembly will be further described in FIGS. 2A-5.

The left audio assembly 110 and the right audio assembly coupled to the headset 100. For example, the left audio assembly 110 and the right audio assembly 115 may couple to the headset 100 using, e.g., a physical coupling mechanism, a magnetic coupling mechanism, or a combination thereof.

The sensor device 120 detects movement of the headset 100. The sensor device 120 includes one or more position sensors and an inertial measurement unit (IMU). In some embodiments, the sensor device 120 is embedded into the front rigid body 105 underneath a surface layer rendering the sensor device 120 invisible to a user of the headset 100. The IMU is an electronic device that generates IMU data based on measurement signals received from one or more of the position sensors. A position sensor generates one or more measurement signals in response to motion of the headset 100. Examples of position sensors include: one or more accelerometers, one or more gyroscopes, one or more magnetometers, another suitable type of sensor that detects motion, a type of sensor used for error correction of the IMU, or some combination thereof. The position sensors may be located external to the IMU, internal to the IMU, or some combination thereof. The IMU and the position sensor will be discussed in greater detail in FIG. 5.

The display system (not shown) provides visual content. The display system has, among other components, an electronic display and an optics block. The electronic display generates image light according to visual content rendered to be presented to the user. The optics block directs the image light to an eye-box of the headset 100 where a user's eyes would be located when the headset 100 is properly worn. The display system may additional comprise other optical elements for various purposes, e.g., focusing of light, correcting for aberrations and/or distortions, magnifying light, directing light from an environment, etc. The display system will be discussed in greater detail in FIG. 5.

Dipole Audio Assembly

Figure 2A:
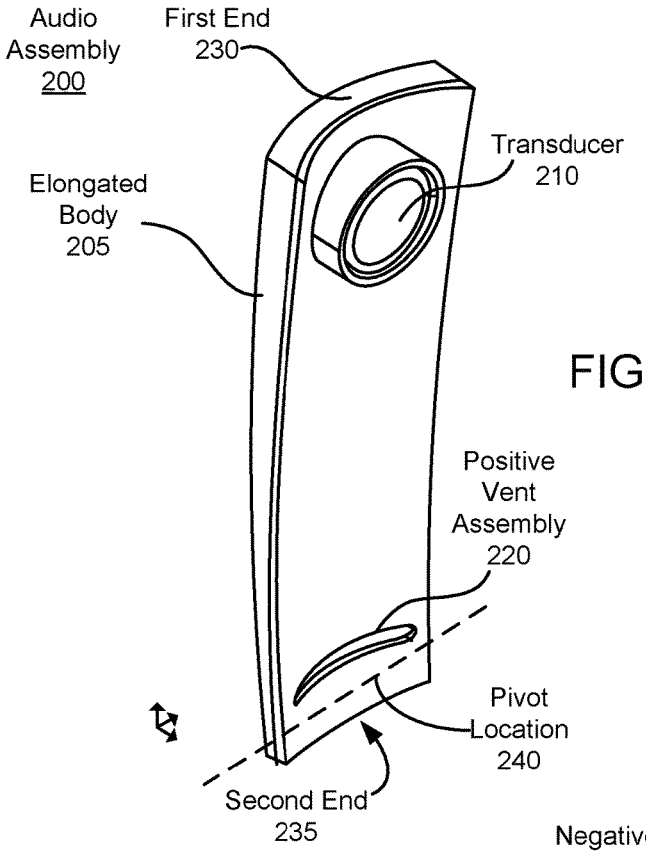
FIG. 2A is a perspective view of an audio assembly, in accordance with one or more embodiments.
Figure 2B:
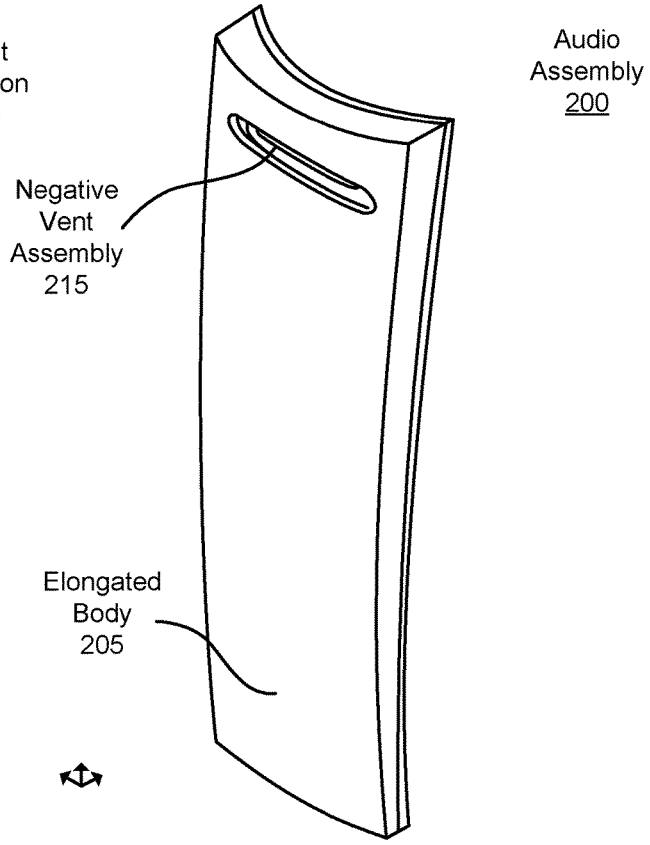
FIG. 2B is a different perspective view of the audio assembly of FIG. 2A.

FIG. 2A is a perspective view of an audio assembly 200, in accordance with one or more embodiments. FIG. 2B is a different perspective view of the audio assembly 200 of FIG. 2A. The audio assembly 200 provides audio content to a user with a dipole effect by generating positive acoustic pressure waves and negative acoustic pressure waves that are vented into free space. The dipole effect is useful for reducing leakage in a far field and improving bass response in a near field given placement of a user's ear. In one or more embodiments, the audio assembly 200 provides acoustic pressure waves to a left or right ear of the user with an additional audio assembly 200 providing acoustic pressure waves to the other ear. The audio assembly 200 comprises an elongated body 205, a transducer 210, a negative vent assembly 215, a positive vent assembly 220. The audio assemblies 110 and 115 of FIG. 1 are embodiments of the audio assembly 200. The audio assembly 200 may comprise additional or fewer components listed herein, e.g., a cap that removably couples to the elongated body which may then removably couple to a band for securing the audio assembly 200 to a user's head. With the audio assembly 200 coupled to a headset, e.g., the headset 100, and the headset appropriately worn by a user, the audio assembly 200 is situated proximate to a side of the user's head where the positive vent assembly 220 is closer to the user's ear than the negative vent assembly 215. This relative placement of the negative vent assembly 215 and the positive vent assembly 220 results in the user's ear being closer to one pole of the dipole than the other pole. This dipole effect provides some leakage reduction in the far field (for low frequencies in particular), improved bass response in the low frequencies, and power efficiency over conventional monopole audio speakers.

The elongated body 205 functions as an audio waveguide. At a first end 230, the elongated body 205 is coupled to the transducer 210 that generates the acoustic pressure waves. The audio waveguide within the elongated body 205 directs the positive acoustic pressure waves generated from a front surface of the transducer from the first end 203 towards a second end 235 of the elongated body. At the second end 235 of the elongated body, is the positive vent assembly 220 which vents the positive acoustic pressure waves for providing audio content to a user. The elongated body 205 may be symmetric about its long dimension. The elongated body 205 may further have a twist such that the first end of the audio waveguide is rotated relative to the second end of the audio waveguide. A degree of the twist may conform generally to a contour of a human head.

A length of the audio waveguide may affect characteristics of the dipole effect created by the audio assembly 200. The length of the audio waveguide affects a distance between the negative vent assembly 215 and the positive vent assembly 220. As discussed above, the locations of the negative vent assembly 215 and the positive vent assembly 220 effectively correspond to poles of the dipole created by the audio assembly 200. A shorter dipole, i.e., a shorter distance between the negative vent assembly 215 and the positive vent assembly 220, diminishes the bass response but would also reduce leakage at higher acoustic frequencies.

The elongated body 205 includes a diaphragm (not shown) within the elongated body 205. The diaphragm substantially spans the length and width of the elongated body 205 and is fixed at a pivot location 240 that is proximate to the second end 235 of the elongated body. The diaphragm is driven by the transducer 210 that is proximate to the first end 230 of the elongated body. The transducer 210 is configured to cause the diaphragm to pivot about the pivot location 240 such that the diaphragm generates a positive acoustic pressure wave from a first surface of the diaphragm and a negative acoustic pressure wave from a second surface of the diaphragm. Note that by fixing the diaphragm at the pivot location, it essentially halves an effective displacement of the entire membrane for a given displacement of the transducer 210. For example, if the transducer were to displace a first distance (e.g., 2 mm), the diaphragm at or near the transducer 210 would also displace about the same amount, but the amount of displacement of the diaphragm reduces as a function of nearness to the pivot location 240—and is zero at the pivot location 240. As such, an effective displacement of the diaphragm over its entire surface area is less than the first distance, and in some cases substantially less (e.g., half of the first displacement). An advantage of this configuration is having the diaphragm fixed at the pivot location 240 allows for a relatively large radiating surface area (Sd) while maintain stability by being fixed at the pivot location 240.

The transducer 210 is used to displace the diaphragm. In one or more implementations, the transducer 210 is a voice coil transducer wherein a voice coil electromagnet may be electrically controlled to drive the diaphragm. Another set of implementations of the transducer 210 utilize electrostatic transducers with a flexible conductive diaphragm controllable by electrically conductive grids sandwiched on either side of the diaphragm which are able to drive displacement of the diaphragm with electrostatic forces. Other implementations or variations of the above implementations of the transducer 210 may include but are not limited to piezoelectric transducers, armature transducers, other mechanical transducers, or any combination thereof.

The first surface of the diaphragm in combination with an interior portion of the elongated body 205 forms one side of front chamber (not shown) in which the positive acoustic pressure waves are generated. The front chamber vents the positive acoustic pressure waves via the positive vent assembly 220. Likewise the second surface of the diaphragm in combination with a different interior portion of the elongated body 205 forms one side of a back chamber (not shown) in which the negative acoustic pressure waves are generated. The back chamber vents the negative acoustic pressure waves via the negative vent assembly 215. In some embodiments, the a volume of the front chamber and a volume of the and the second volume are matched.

The negative vent assembly 215 vents negative acoustic pressure waves, e.g., for improving bass response and leakage reduction. The negative vent assembly 215 comprises one or more negative vents that vent negative acoustic pressure waves into free space. The number of negative vents, the shape of the negative vents, the size of the negative vents, or any combination thereof may vary in various implementations. For example, one implementation may utilize four negative vents in the negative vent assembly 215, whereas in others there may be a single elliptical shaped vent (e.g., as shown). In some embodiments, each negative vent may include a negative vent mesh to prevent dust from reaching the transducer. Note that in other embodiments, the negative vent assembly 215 may be located elsewhere on the elongated body 205.

The positive vent assembly 220 vents positive acoustic pressure waves for providing audio content to a user. The positive vent assembly 220 comprises at least one positive vent that vents positive acoustic pressure waves into free space. The vented positive acoustic pressure waves are detectable by a user's ear as the audio content. In a similar manner as described for the negative vent assembly 215, configuration of the positive vent assembly 220 may vary in number of positive vents, shape of positive vents, size of positive vents, or any combination thereof, which influences one or more characteristics of the vented positive acoustic pressure waves (e.g., amplitude, frequencies, reverberation, distortion, etc.). As shown in FIG. 2A, the positive vent assembly 220 comprises one positive vent of an elliptical shape placed on a side of the elongated body 205 that would be oriented towards a user's ear. With the audio assembly 200 coupled to a headset, e.g., the headset 100, the positive vent is located to be closer to a user's ear than the negative vents of the negative vent assembly 215. Placing the user's ear close to the positive vent assembly 220 (i.e., one pole of the dipole) allows for the benefits of the dipole effect, the benefits including the improved bass response in low frequencies and improved leakage reduction. Note that in other embodiments, the positive vent assembly 220 may be located elsewhere on the elongated body 205.

In some embodiments, a configuration of the positive vent assembly 220 and a configuration of the negative vent assembly 215 affect the dipole effect. In one aspect, a total open area corresponding to positive vents of the positive vent assembly 220 and/or a total open area of negative vents of the negative vent assembly 215 affect a strength of the dipole effect. The total open area of the positive vent assembly 220 corresponds to an aggregate area of one or more openings of the one or more positive vents of the positive vent assembly 220. Similarly, the total open area of the negative vent assembly 215 corresponds to an aggregate area of one or more openings of the one or more negative vents of the negative vent assembly 215. As either the total open area of the negative assembly 215 or the total open area of the positive vent assembly 220 is significantly lower than the other, the strength of the dipole effect diminishes as the influence of vented acoustic pressure waves from either the positive vent assembly 220 or the negative vent assembly 220 is greatly diminished compared to vented acoustic pressure waves from the other vent assembly. The configuration of the positive vent assembly 220 and the configuration of the negative vent assembly 215 may be optimized according to a strength of the dipole effect to be achieved by the audio assembly 200. As mentioned, the strength of the dipole effect affects the bass response in the low frequencies and the leakage reduction.

The configurations of the positive vent assembly 220 and the negative vent assembly 215 can also affect the power efficiency. The power efficiency of the audio assembly 200 also directly depends on the total open area of the negative vent assembly 215 and the total open area of the positive vent assembly 220. As such, the power efficiency increases with the total open area of the negative vent assembly 215 and/or the total open area of the positive vent assembly 220. Understandably, if the opening on either end of the audio assembly 200 is smaller, then less air can be displace in and out which can build up pressure in the elongated body 205 and/or the back chamber requiring the transducer to work harder thereby reducing power efficiency of the audio assembly 200. The converse also holds, as the opening on either end of the audio assembly 200 is bigger, more air can be displaced through the openings which reduces the difficulty on the transducer 210 and diaphragm yielding improved power efficiency of the audio assembly 200.

Figure 3:
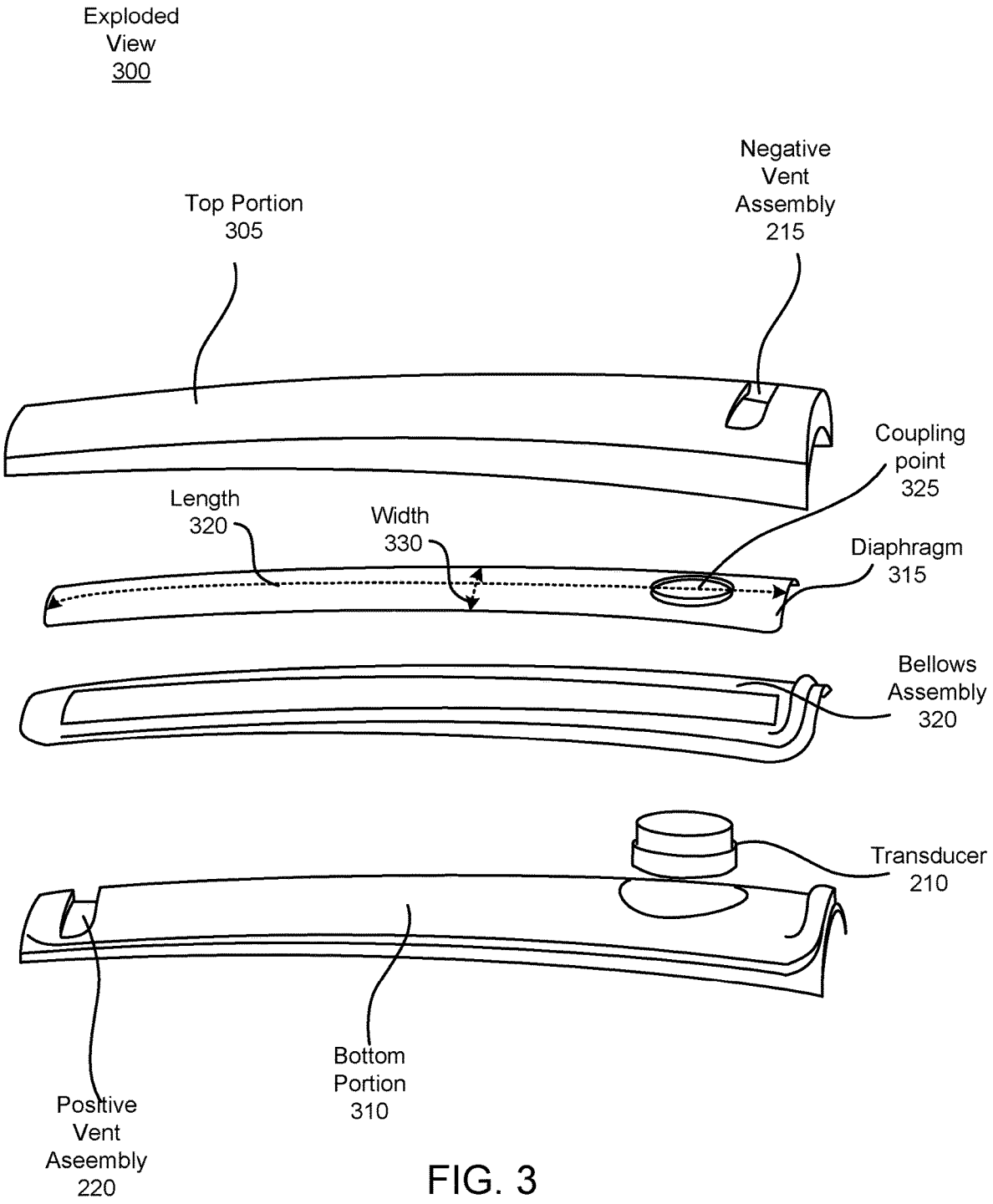
FIG. 3 is an exploded view of the audio assembly of FIG. 2A.

FIG. 3 is an exploded view 300 of the audio assembly 200 of FIG. 2A. The exploded view 300 illustrates various components implemented within the audio assembly 200: a top portion 305 of the elongated body 205, a bottom portion 310 of the elongated body 205, the transducer 210, a diaphragm 315, a bellows assembly 320, the negative vent assembly 215, and the positive vent assembly 220.

The top portion 305 of the elongated body 205 and the bottom portion 310 of the elongated body 205 couple together to form the elongated body 205 that includes the diaphragm 315, the bellows assembly 320, and the transducer 210. The top portion 305 and the bottom portion 310 may be formed from, e.g., plastic, metal, some other suitable material, or some combination thereof.

As describe above with references to FIGS. 2A-2B the diaphragm 315 is used to generate positive acoustic pressure waves and negative acoustic pressure waves. The diaphragm 315 includes a coupling point 325 at which the transducer 210 couples to and displaces the diaphragm 315. The diaphragm 315 has a length 320 and a width 330 that is orthogonal to the length 320, and the length 320 is larger than the width 330.

The bellows assembly 320 is holds the diaphragm 315. The bellows assembly 320 is configured to allow the diaphragm to pivot about the pivot location. The bellows assembly 320 may be formed from, e.g., rubber, silicon, some other flexible material. The bellows assembly 320 is configured to allow the diaphragm 315 to displace more proximate to the transducer 210 than proximate to the pivot location.

Figure 4A:
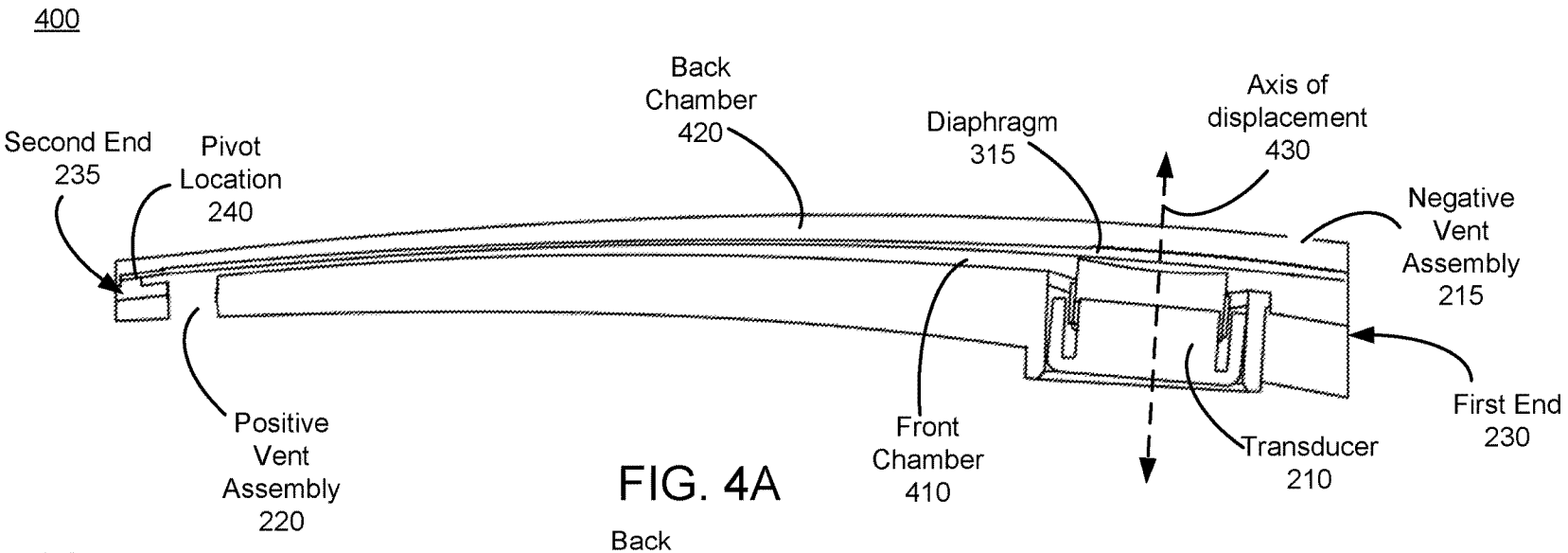
FIG. 4A is a cross sectional view of the audio assembly of FIG. 2A with the transducer at a first displacement position, according to one or more embodiments.

FIG. 4A is a cross sectional view 400 of the audio assembly 200 of FIG. 2A with the transducer 210 at a first displacement position, according to one or more embodiments. Note that in the view 400 is clear that the diaphragm 315 in combination with interior portions of the elongated body 205 form a front chamber 410 and a back chamber 420. The transducer 210 is configured to displace along an axis of displacement 430, and movement along the axis of displacement 430 causes the diaphragm 315 to also displace. The diaphragm 315 is fixed at the pivot location 240, such that displacement of the transducer 210 causes the diaphragm 315 to pivot about the pivot location 240. In this manner a range of motion of the diaphragm 315 is greater proximate to the first end 230 of the elongated body than a range of motion of the diaphragm 315 proximate to the second end 235 of the elongated body. In some embodiments, a maximum displacement value of the transducer 210 is more than an average displacement value of the diaphragm 315 while the transducer 210 is at maximum displacement.

Figure 4B:
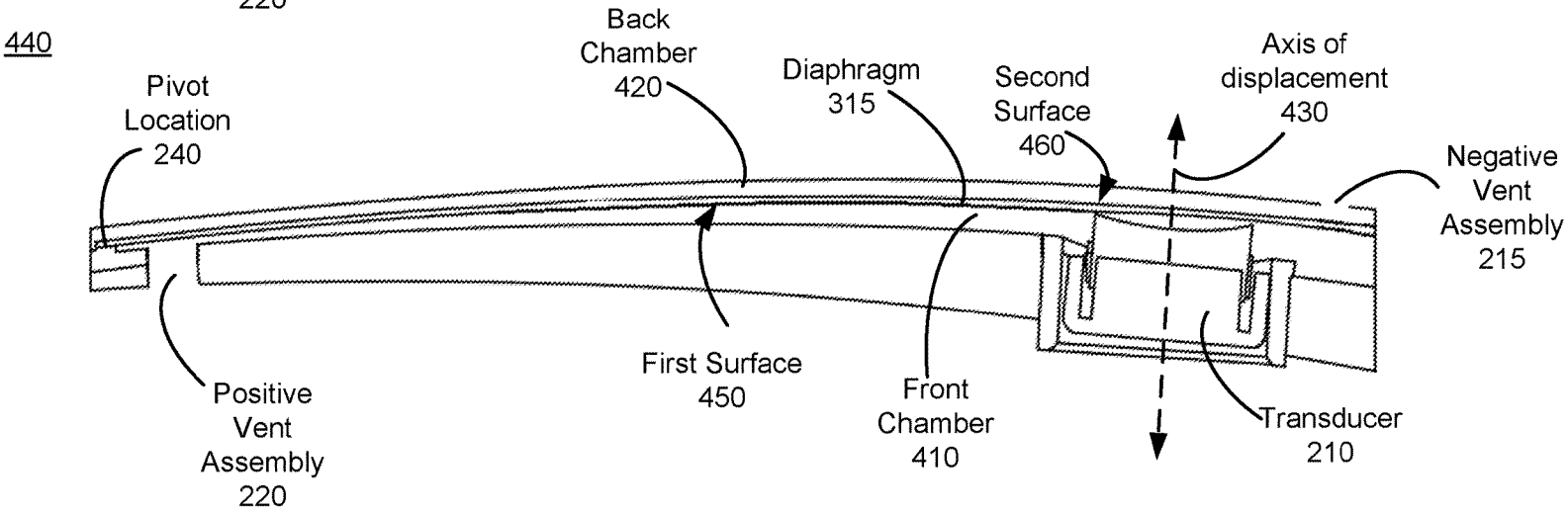
FIG. 4B is a cross section view of the audio assembly of FIG. 4A, with the transducer at a second displacement position.

FIG. 4B is a cross section view 440 of the audio assembly of FIG. 4A, with the transducer 210 at a second displacement position. As illustrated, the transducer 210 has displaced along the axis of displacement 430 toward the diaphragm 315. Accordingly, the displacement of the transducer 210 has caused displacement of the diaphragm 315, but the amount of displacement of the diaphragm 315 differs as a function of proximity to the pivot location 240. Specifically, the displacement of the diaphragm 315 ranges from a maximum value proximate to the first end 230 of the elongated body to zero displacement at the pivot location 240. Note that in FIG. 4B the displacement of the diaphragm 315 causes the volume of the front chamber 410 to increase relative to the volume of the front chamber 410 in 4A, and causes the volume of the back chamber 420 to decrease relative to the volume of the back chamber 420 in FIG. 4A.

As described above, the transducer 210 drives the diaphragm 315 to produce positive acoustic pressure waves and negative acoustic pressure waves. As illustrated the diaphragm 315 is configured to pivot about the pivot location 240 such that the diaphragm 315 generates a positive acoustic pressure wave from a first surface 450 of the diaphragm 315 and a negative acoustic pressure wave from a second surface 460 of the diaphragm 315. The front chamber 410 vents the positive acoustic pressure waves via the positive vent assembly 220. Similarly, the back chamber 420 vents the negative acoustic pressure waves via the negative vent assembly 215.

Artificial Reality System Environment

Figure 5:
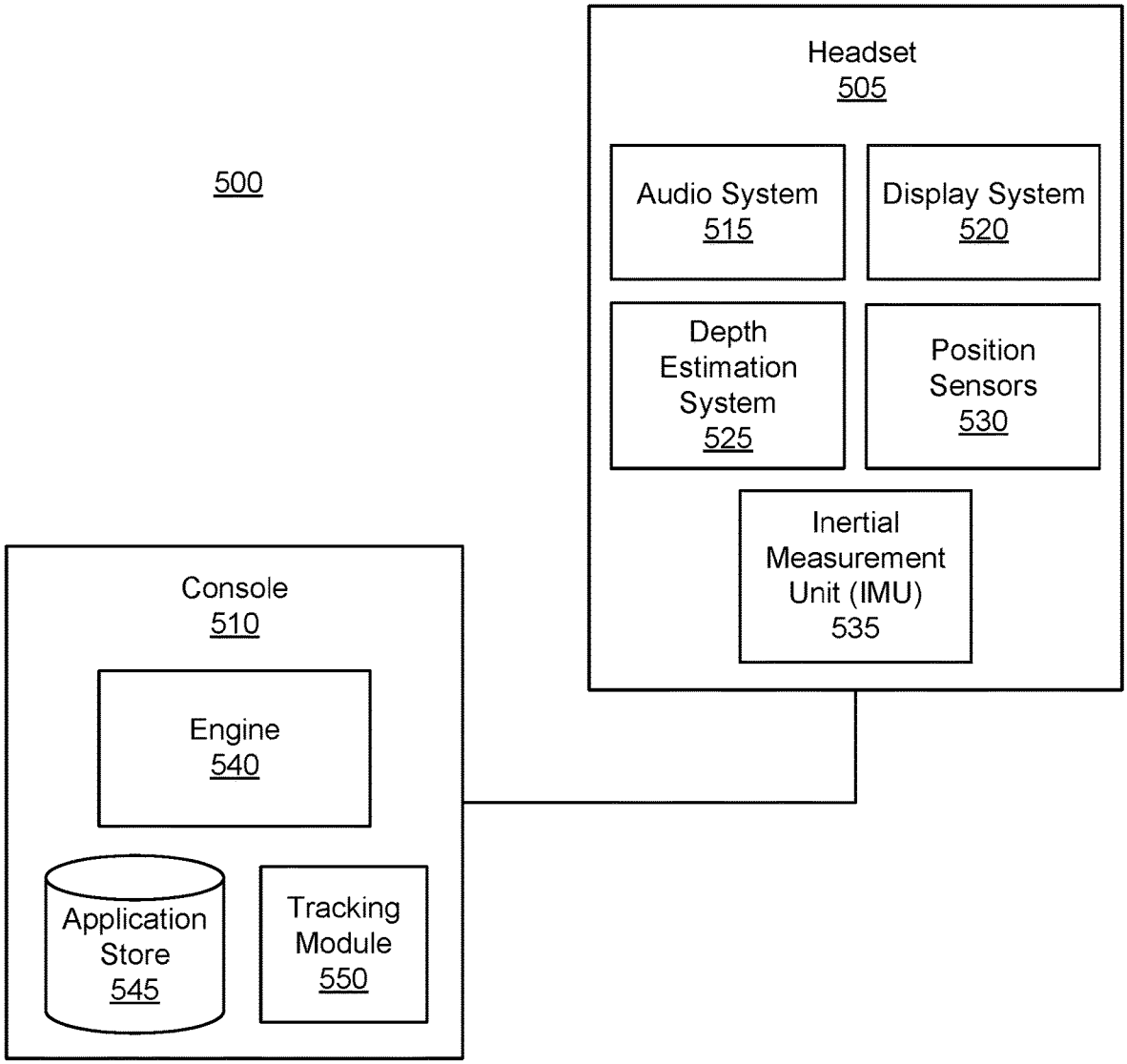
FIG. 5 is a system environment of an artificial reality system including a headset that includes one or more audio systems, in accordance with one or more embodiments.

FIG. 5 is a system environment of an artificial reality system 500 including a headset 505, in accordance with one or more embodiments. The system 500 may operate in an artificial reality context, e.g., a virtual reality, an augmented reality, a mixed reality context, or some combination thereof. The system 500 shown by FIG. 5 comprises a headset 505 and may additionally include other input/output (I/O) devices (not shown) that may be coupled to a console 510. The headset 100 is one embodiment of the headset 505. While FIG. 5 shows an example system 500 including one headset 505, in other embodiments, any number of additional components may be included in the system 500. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 510 may be integrated into the headset 505.

The headset 505 presents content to a user. The headset 505 may be an eyewear device, a head-mounted display, an earbud, a headphone, or another type of device placed on a head. In some embodiments, the presented content includes audio content via an audio system 515, visual content via a display system 520, haptic feedback from one or more haptic feedback devices (not shown in FIG. 5), etc. In some embodiments, the headset 505 presents virtual content to the user that is based in part on depth information of a real local area surrounding the headset 505. For example, the user wearing the headset 505 may be physically in a room, and virtual walls and a virtual floor corresponding to walls and floor in the room are rendered as part of the virtual content presented by the headset 505. In another example, a virtual character or a virtual scene may be rendered as an augmentation to views of the real world through the headset 505.

The headset 505 includes an audio system 515, a display system 520, a depth estimation system 525, position sensors 530, and an inertial measurement Unit (IMU) 535. Some embodiments of the headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505. In one or more examples, the headset 505 includes an eye-tracking system, a haptic feedback system, one or more light sources (e.g., for structured illumination light), etc.

The audio system 515 presents audio content to a user of the headset 505. The audio content may be provided by the console 510 to be presented by the headset 505. The audio system 515 comprises one or more audio assemblies that generate acoustic pressure waves that constitute the audio content provided to the user of the headset 505. The audio assemblies may be embodiments of the left audio assembly 110, the right audio assembly 115, the audio assembly 200, etc. The audio assemblies are configured as dipole speakers emanating both positive pressure acoustic pressure waves and negative acoustic pressure waves. At least one of the audio assemblies comprises an elongated body including an audio waveguide, a negative vent assembly, a positive vent assembly, and a transducer. The negative vent assembly is coupled to the elongated body and includes at least one negative vent that vents negative acoustic pressure waves generated by a back surface of a transducer coupled to a first end of the audio waveguide within the elongated body. The positive vent assembly is part of the elongated body and coupled to a second, opposite end of the audio waveguide. The positive vent assembly includes at least one positive vent that vents positive acoustic pressure waves generated by a front surface of the transducer. The vented acoustic pressure waves from the negative vent assembly and the positive vent assembly traverse free space to the user's ears which are then perceived as at least a portion of the audio content. In other embodiments, the audio system 515 incorporates other types of transducers that may provide some portion of the audio content, e.g., via bone conduction.

The following process examples how the audio assembly provides audio content. The audio system 515 obtains audio content to be provided to the user. The audio system 515 identifies one or more of the audio assemblies to instruct to provide at least a portion of the audio content. Each audio assembly that is designated drives the transducer of the audio assembly to generate positive acoustic pressure waves from the front surface of the transducer and negative acoustic pressure waves from the back surface of the transducer. The positive acoustic pressure waves propagate down the front chamber and are vented by the positive vent assembly into free space. The negative acoustic pressure waves fill a back chamber are vented by the negative vent assembly into free space. A user's ear detects the vented positive acoustic pressure waves from the positive vent assembly, whereby the user perceives the audio content. By placing the positive vent assembly closer to a user's ear than the negative vent assembly, a dipole is created between the vented positive acoustic pressure waves and the vented negative acoustic pressure waves, which can improve bass response in the low frequencies compared to conventional monopole audio speakers.

Moreover, as the diaphragm generating the positive acoustic pressure waves and the negative acoustic pressure waves is fixed at a pivot location. An effective displacement of the diaphragm over its entire surface area is less than the displacement of the transducer, and in some cases substantially less (e.g., half). An advantage of this configuration is having the diaphragm fixed at the pivot location allows the diaphragm to have a relatively large Sd while maintaining stability by being fixed at the pivot location.

The display system 520 presents visual content to a user of the headset 505. The visual content presented may take into account depth information determined by the depth estimation system 525. The display system 520 may comprise an electronic display and an optics block. The electronic display displays 2D or 3D images to the user in accordance with data received from the console 510. In various embodiments, the electronic display comprises a single electronic display or multiple electronic displays (e.g., a display for each eye of a user). Examples of the electronic display include: a liquid crystal display (LCD), an organic light emitting diode (OLED) display, an active-matrix organic light-emitting diode display (AMOLED), a waveguide display, some other display, or some combination thereof.

The optics block magnifies image light received from the electronic display, corrects optical errors associated with the image light, and presents the corrected image light to a user of the headset 505. In various embodiments, the optics block includes one or more optical elements. Example optical elements included in the optics block include: a waveguide, an aperture, a Fresnel lens, a convex lens, a concave lens, a filter, a reflecting surface, or any other suitable optical element that affects image light. Moreover, the optics block may include combinations of different optical elements. In some embodiments, one or more of the optical elements in the optics block may have one or more coatings, such as partially reflective or anti-reflective coatings.

Magnification and focusing of the image light by the optics block allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block corrects the distortion when it receives image light from the electronic display generated based on the content.

The depth estimation system 525 determines depth information of an environment around the headset 505. The depth information may include a depth map of the environment at an instant of time. The depth estimation system 525 comprises two or more cameras and a controller. The cameras capture images of the environment with some overlapping field of view. With the captured images, the depth estimation system 525 can use any of numerous imaging analysis techniques to determine correspondences between the captured image which may be used for depth estimation. In other embodiments, the depth estimation system 525 assesses other data received by other components of the headset 505 to determine depth information, e.g., movement. For example, the headset 505 may include proximity sensors that can be also be used alone or in conjunction with the captured images to determine depth information. The depth information determined by the depth estimation system 525 may be used to improve content presented by the headset 505.

The IMU 535 is an electronic device that generates data indicating a position of the headset 505 based on measurement signals received from one or more of the position sensors 530. A position sensor 530 generates one or more measurement signals in response to motion of the headset 505. Examples of position sensors 530 include: one or more accelerometers, one or more gyroscopes, one or more magnetometers, another suitable type of sensor that detects motion, a type of sensor used for error correction of the IMU 535, or some combination thereof. The position sensors 530 may be located external to the IMU 535, internal to the IMU 535, or some combination thereof.

Based on the one or more measurement signals from one or more position sensors 530, the IMU 535 generates head-tracking data indicating an estimated current position of the headset 505 relative to an initial position of the headset 505. For example, the position sensors 530 include multiple accelerometers to measure translational motion (forward/back, up/down, left/right) and multiple gyroscopes to measure rotational motion (e.g., pitch, yaw, and roll). In some embodiments, the IMU 535 rapidly samples the measurement signals and calculates the estimated current position of the headset 505 from the sampled data. For example, the IMU 535 integrates the measurement signals received from the accelerometers over time to estimate a velocity vector and integrates the velocity vector over time to determine an estimated current position of a reference point on the headset 505. Alternatively, the IMU 535 provides the sampled measurement signals to the console 510, which interprets the head-tracking data to reduce error. The reference point is a point that may be used to describe the position of the headset 505. The reference point may generally be defined as a point in space or a position related to the headset's 505 orientation and position.

The console 510 provides content to the headset 505 for processing in accordance with information received from the headset 505. In the example shown in FIG. 5, the console 510 includes an application store 545, a tracking module 550, and an engine 540. Some embodiments of the console 510 have different modules or components than those described in conjunction with FIG. 5. Similarly, the functions further described below may be distributed among components of the console 510 in a different manner than described in conjunction with FIG. 5.

The application store 545 stores one or more applications for execution by the console 510. An application is a group of instructions that, when executed by a processor, generates content for presentation to the user. Content generated by an application may be in response to inputs received from the user via movement of the headset 505 or any input/output devices. Examples of applications include: gaming applications, conferencing applications, video playback applications, or other suitable applications.

The tracking module 550 calibrates the system environment using one or more calibration parameters and may adjust one or more calibration parameters to reduce error in determination of the position of the headset 505. Calibration performed by the tracking module 550 also accounts for information received from the IMU 535 in the headset 505. Additionally, if tracking of the headset 505 is lost, the tracking module 550 may re-calibrate some or all of the system environment.

The tracking module 550 tracks movements of the headset 505 as head-tracking data using information from the one or more position sensors 530, the IMU 535, or some combination thereof. For example, the tracking module 550 determines a position of a reference point of the headset 505 in a mapping of a local area based on information from the headset 505. Additionally, in some embodiments, the tracking module 550 may use portions of information to predict a future position of the headset 505. The tracking module 550 provides the head-tracking data inclusive of the estimated and/or predicted future position of the headset 505 to the engine 540.

The engine 540 also executes applications within the system environment and receives depth information from the depth estimation system 525, position information, acceleration information, velocity information, predicted future positions, or some combination thereof, of the headset 505 from the tracking module 550. Based on the received information, the engine 540 determines content to provide to the headset 505 for presentation to the user. For example, if the received information indicates that the user has looked to the left, the engine 540 generates content for the headset 505 that mirrors the user's movement in a virtual environment or in an environment augmenting the local area with additional content. Additionally, the engine 540 performs an action within an application executing on the console 510, in response to any inputs received from headset 505, and provides feedback to the user that the action was performed. The provided feedback may be visual via the headset 505. In response, the engine 540 may perform one or more of the actions in the command and/or generate subsequent content to be provided to the headset 505 based on the commands.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. An audio assembly comprising:

an elongated body that has a first end and a second end opposite the first end;

a diaphragm within the elongated body that extends from a first location that is proximate to the first end to a second location that is proximate to the second end and is configured to pivot about a pivot location that is proximate the second end;

a transducer within the elongated body and positioned proximate to the first end, the transducer configured to cause the diaphragm to pivot about the pivot location such that the diaphragm generates a positive acoustic pressure wave from a first surface of the diaphragm and a negative acoustic pressure wave from a second surface of the diaphragm, and for a given amount of displacement of the transducer, a portion of the diaphragm that is proximate to the transducer displaces more than a portion of the diaphragm that is proximate to the pivot location; and a plurality of vent assemblies along one or more surfaces of the elongated body, the plurality of vent assemblies configured to vent the positive acoustic pressure wave and the negative acoustic pressure wave.

2. The audio assembly of claim 1, wherein a range of motion of the diaphragm is greater proximate to the first end of the elongated body than a range of motion of the diaphragm proximate to the second end of the elongated body.

3. The audio assembly of claim 1, wherein the diaphragm has a length and a width, and the length is larger than the width.

4. The audio assembly of claim 1, wherein a maximum displacement value of the transducer is more than an average displacement value of the diaphragm while the transducer is at maximum displacement.

5. The audio assembly of claim 1, wherein the plurality of vent comprises:

a negative vent assembly in the elongated body and positioned proximate to the first end, the negative vent assembly configured to vent the negative acoustic pressure wave; and a positive vent assembly in the elongated body and positioned proximate to the second end, the positive vent assembly configured to output the positive acoustic pressure wave.

6. The audio assembly of claim 5, wherein the elongated body has a first side and a second side opposite the first side, the first side oriented towards an ear of a user, and wherein the positive vent of the positive vent assembly is on the first side of the elongated body.

7. The audio assembly of claim 6, wherein a positive vent of the positive vent assembly is a single elliptical shaped vent.

8. The audio assembly of claim 6, wherein a negative vent of the negative vent assembly is a single elliptical shaped vent.

9. The audio assembly of claim 1, wherein the first surface of the diaphragm and a portion of an interior of the elongated body form a first chamber in which the positive pressure wave is formed, and the second surface of the diaphragm and a different portion of the interior of the elongated body form a second chamber in which the negative pressure wave is formed.

10. The audio assembly of claim 9, wherein a volume of the first chamber and a volume of the second chamber are matched.

11. The audio assembly of claim 1, wherein the positive vent assembly is configured to be closer to an ear of a user than the negative vent assembly.

12. The audio assembly of claim 1, wherein the audio assembly is part of a headset.

13. An audio assembly comprising:

an elongated body that has a first end and a second end opposite the first end;

a diaphragm within the elongated body that extends from a first location that is proximate to the first end to a second location that is proximate to the second end and is configured to pivot about a pivot location that is proximate the second end;

a bellows assembly configured to hold the diaphragm, and allow the diaphragm to pivot about the pivot location;

a transducer within the elongated body and positioned proximate to the first end, the transducer configured to cause the diaphragm to pivot about the pivot location such that the diaphragm generates a positive acoustic pressure wave from a first surface of the diaphragm and a negative acoustic pressure wave from a second surface of the diaphragm, and for a given amount of displacement of the transducer, a portion of the diaphragm that is proximate to the transducer displaces more than a portion of the diaphragm that is proximate to the pivot location;

a negative vent assembly in the elongated body and positioned proximate to the first end, the negative vent assembly configured to vent the negative acoustic pressure wave; and a positive vent assembly in the elongated body and positioned proximate to the second end, the positive vent assembly configured to output the positive acoustic pressure wave.

14. The audio assembly of claim 13, wherein a range of motion of the diaphragm and the bellows assembly is greater proximate to the first end of the elongated body than a range of motion of the diaphragm and the bellows proximate to the second end of the elongated body.

15. The audio assembly of claim 13, wherein the diaphragm has a first radius and a second radius that is orthogonal to the first radius, and the first radius is larger than the second radius.

16. The audio assembly of claim 13, wherein a maximum displacement value of the transducer is more than an average displacement value of the diaphragm while the transducer is at maximum displacement.

17. The audio assembly of claim 13, wherein the elongated body has a first side and a second side opposite the first side, the first side oriented towards an ear of a user, and wherein the positive vent of the positive vent assembly is on the first side of the elongated body.

18. The audio assembly of claim 13, wherein the first surface of the diaphragm and a portion of an interior of the elongated body form a first chamber in which the positive pressure wave is formed, and the second surface of the diaphragm and a different portion of the interior of the elongated body form a second chamber in which the negative pressure wave is formed.

19. The audio assembly of claim 13, wherein the positive vent assembly is configured to be closer to an ear of a user than the negative vent assembly.

20. A headset comprising:

one or more audio assemblies, each audio assembly comprising:

an elongated body that has a first end and a second end opposite the first end;

a diaphragm within the elongated body that extends from a first location that is proximate to the first end to a second location that is proximate to the second end and is configured to pivot about a pivot location that is proximate the second end;

a transducer within the elongated body and positioned proximate to the first end, the transducer configured to cause the diaphragm to pivot about the pivot location such that the diaphragm generates a positive acoustic pressure wave from a first surface of the diaphragm, and for a given amount of displacement of the transducer, a portion of the diaphragm that is proximate to the transducer displaces more than a portion of the diaphragm that is proximate to the pivot location; and a vent assembly along a surface of the elongated body, the vent assembly configured to vent the positive acoustic pressure wave toward an ear of a user of the headset.

* * * * *